US009023786B2

(12) United States Patent
Schmiedel et al.

(10) Patent No.: US 9,023,786 B2
(45) Date of Patent: May 5, 2015

(54) STRUCTURED DETERGENT OR CLEANING AGENT

(71) Applicant: Henkel AG & Co. KGaA, Duesseldorf (DE)

(72) Inventors: Peter Schmiedel, Duesseldorf (DE); Luca Bellomi, Duesseldorf (DE); Aleidatje M. Lester, Phoenix, AZ (US); Martina Hutmacher, Duesseldorf (DE); Ines Baranski, Cologne (DE); Hendrik Hellmuth, Duesseldorf (DE); Timothy O'Connell, Duesseldorf (DE); Thomas Weber, Dormagen (DE); Nadine Langenscheidt-Dabringhausen, Baesweiler (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/265,680

(22) Filed: Apr. 30, 2014

(65) Prior Publication Data

US 2014/0235524 A1 Aug. 21, 2014

Related U.S. Application Data

(63) Continuation of application No. PCT/EP2012/070329, filed on Oct. 12, 2012.

(30) Foreign Application Priority Data

Nov. 2, 2011 (DE) ..... 10 2011 085 638
Feb. 10, 2012 (DE) ..... 10 2012 201 980

(51) Int. Cl.

| | |
|---|---|
| ***C11D 1/12*** | (2006.01) |
| ***C11D 1/75*** | (2006.01) |
| ***C11D 1/83*** | (2006.01) |
| ***C11D 1/72*** | (2006.01) |
| ***C11D 1/831*** | (2006.01) |
| ***C11D 1/65*** | (2006.01) |
| ***C11D 1/655*** | (2006.01) |
| ***C11D 3/04*** | (2006.01) |
| ***C11D 3/10*** | (2006.01) |
| ***C11D 3/20*** | (2006.01) |
| ***C11D 17/00*** | (2006.01) |
| *C11D 1/14* | (2006.01) |
| *C11D 1/22* | (2006.01) |
| *C11D 1/28* | (2006.01) |
| *C11D 1/29* | (2006.01) |
| *C11D 1/52* | (2006.01) |
| *C11D 1/66* | (2006.01) |
| *C11D 1/74* | (2006.01) |

(52) U.S. Cl.

CPC ..... *C11D 1/831* (2013.01); *C11D 1/143* (2013.01); *C11D 1/146* (2013.01); *C11D 1/22* (2013.01); *C11D 1/28* (2013.01); *C11D 1/29* (2013.01); *C11D 1/521* (2013.01); *C11D 1/525* (2013.01); *C11D 1/526* (2013.01); *C11D 1/652* (2013.01); *C11D 1/655* (2013.01); *C11D 1/662* (2013.01); *C11D 1/667* (2013.01); *C11D 1/72* (2013.01); *C11D 1/74* (2013.01); *C11D 1/75* (2013.01); *C11D 1/83* (2013.01); *C11D 1/8305* (2013.01); *C11D 3/046* (2013.01); *C11D 3/10* (2013.01); *C11D 3/2006* (2013.01); *C11D 3/2013* (2013.01); *C11D 3/2034* (2013.01); *C11D 3/2041* (2013.01); *C11D 3/2044* (2013.01); *C11D 3/2093* (2013.01); *C11D 17/0026* (2013.01)

(58) Field of Classification Search

CPC ..... C11D 3/2041; C11D 3/2044; C11D 17/0013; C11D 17/0026; C11D 1/12; C11D 1/75; C11D 1/83; C11D 1/72; C11D 3/046; C11D 3/2006; C11D 3/201; C11D 3/2013; C11D 3/2003; C11D 17/0039

See application file for complete search history.

(56) References Cited

U.S. PATENT DOCUMENTS

| | | | | |
|---|---|---|---|---|
| 5,723,431 | A | 3/1998 | Yianakopoulos et al. | |
| 5,952,285 | A * | 9/1999 | Hawkins | 510/405 |
| 2002/0049149 | A1 | 4/2002 | Durbut et al. | |
| 2013/0251659 | A1 * | 9/2013 | Derks et al. | 424/70.17 |

FOREIGN PATENT DOCUMENTS

WO 2007/008510 A1 1/2007

OTHER PUBLICATIONS

PCT International Search Report (PCT/EP2012/070329) dated Apr. 2, 2013.

* cited by examiner

*Primary Examiner* — Charles Boyer
(74) *Attorney, Agent, or Firm* — Thomas G. Krivulka

(57) ABSTRACT

The invention describes a stable liquid washing agent or liquid cleaning agent having a yield point and very good dispersing properties. The agents contain anionic and non-ionic surfactants as well as inorganic salt and cosurfactant. The invention also relates to the use of the liquid washing agent or liquid cleaning agent, and to a method for manufacturing it.

12 Claims, No Drawings

STRUCTURED DETERGENT OR CLEANING AGENT

FIELD OF THE INVENTION

The present invention generally relates to a liquid washing or cleaning agent having a yield point, containing anionic and nonionic surfactant. The invention also relates to the use of the washing or cleaning agent, and to a method for manufacturing it.

BACKGROUND OF THE INVENTION

Suspending solids in liquids in stable fashion is often problematic. Especially when the solids differ from the liquid in terms of density, they tend to sediment or to float.

One method for suspending relative large particles, for example visible capsules, is based on structured surfactant systems. The term "structured surfactant system" refers to aqueous systems that comprise surfactant structures which are larger than usual spherical micelles and whose interaction imparts thixotropic properties to the aqueous medium. These structures can be solid, can form a mesophase, or can be liquid, and can be present in the form of multi-layer spherulites, rods, disks, or flakes, which are dispersed or emulsified discontinuously in the system or form weak network structures.

Three principal types of suspended systems have been utilized in practice, all involving an $L_\alpha$ phase in which double layers of surfactants are arranged with the hydrophobic part of the molecule on the inner side and the hydrophilic part on the outer side of the double layer (or vice versa). The double layers are located side by side, for example in a parallel or concentric arrangement, sometimes separated by aqueous layers. $L_\alpha$ phases can usually be identified by their characteristic texture under a polarization microscope, and/or by X-ray diffraction.

Most surfactants form an $L_\alpha$ phase, at either ambient or slightly higher temperature, when they are mixed with water at certain specific ratios. $L_\alpha$ phases of this kind generally cannot, however, be used as structured suspended systems. Useful quantities of solids cause the systems to no longer be pourable, and smaller quantities of solids tend to sediment. The concentrations at which $L_\alpha$ phases occur are also often appreciably higher than the concentrations usual and/or desired in liquid washing and cleaning agents.

The principal types of structured system that are used in practice are based on dispersed lamellar, spherulitic, and attenuated lamellar phases.

Dispersed lamellar phases are two-phase systems in which the surfactant double layers are arranged as parallel plates in order to form regions made up of $L_\alpha$ phases that are penetrated by an aqueous phase in order to form an opaque, gel-like system.

Spherulitic phases comprise spherical bodies, usually referred to technically as "spherulites," in which surfactant double layers are arranged as concentric shells. The spherulites usually have a diameter in the range from 0.1 to 15 μm and are dispersed in an aqueous phase in the manner of a classic emulsion. The spherulites interact to form a structured system.

Many structured surfactant systems fall between lamellar dispersed and spherulitic. The surfactant systems comprise both structure types. Systems having a more strongly spherulitic character are usually preferred, since they result in lower viscosities.

A third type of structured surfactant system comprises an expanded $L_\alpha$ phase. It differs from the other two types of structured system in that it is substantially a single phase, and from conventional $L_\alpha$ phases in that it has a broader d-spacing.

Structured surfactant systems having dispersed lamellar or spherulitic phases are typically formed by the interaction of surfactants with dissolved electrolyte salts or bases. WO 2007/08510 A1, for example, discloses structured hand dishwashing or scrubbing agents.

Structured surfactant systems of this kind, however, often exhibit no yield points or insufficiently high yield points and/or contain very large amounts of electrolyte. The latter, in washing or cleaning agents that are used in automatic washing machines or dishwashers, results in increased corrosion in the machines.

An object of the invention is therefore to provide a structured liquid washing or cleaning agent having a yield point, which is also suitable in particular for use in automatic washing machines or dishwashers.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A liquid washing or cleaning agent having a yield point, containing: 5 to 20 wt % anionic surfactant selected from the group consisting of sulfonate surfactants, sulfate surfactants, and mixtures thereof; 1 to 15 wt % nonionic surfactant selected from the group consisting of alkoxylated fatty alcohols having a degree of alkoxylation ≥4, alkoxylated fatty acid alkyl esters, fatty acid amides, alkoxylated fatty acid amides, polyhydroxy fatty acid amides, alkyl phenol polyglycol ethers, amine oxides, alkylpolyglucosides, and mixtures thereof; 0.5 to 10 wt % of an inorganic salt; and 0.5 to 5 wt % of a cosurfactant selected from the group consisting of alkoxylated $C_8$ to $C_{18}$ fatty alcohols having a degree of alkoxylation ≤3, aliphatic $C_6$ to $C_{14}$ alcohols, aromatic $C_6$ to $C_{14}$ alcohols, aliphatic $C_6$ to $C_{12}$ dialcohols, monoglycerides of $C_{12}$ to $C_{18}$ fatty acids, monoglycerol ethers of $C_8$ to $C_{18}$ fatty alcohols, and mixtures thereof.

Use of a combination of 0.5 to 10 wt % of an inorganic salt and 0.5 to 5 wt % of a cosurfactant to generate a yield point in a liquid washing or cleaning agent containing: 5 to 20 wt % anionic surfactant selected from the group consisting of sulfonate surfactants, sulfate surfactants, and mixtures thereof; 1 to 15 wt % nonionic surfactant selected from the group consisting of alkoxylated fatty alcohols having a degree of alkoxylation ≥4, alkoxylated fatty acid alkyl esters, fatty acid amides, alkoxylated fatty acid amides, polyhydroxy fatty acid amides, alkyl phenol polyglycol ethers, amine oxides, alkylpolyglucosides, and mixtures thereof; wherein the cosurfactant is selected from the group consisting of alkoxylated $C_8$ to $C_{18}$ fatty alcohols having a degree of alkoxylation ≤3, aliphatic $C_6$ to $C_{14}$ alcohols, aromatic $C_6$ to $C_{14}$ alcohols, aliphatic $C_6$ to $C_{12}$ dialcohols, monoglycerides of $C_{12}$ to $C_{18}$ fatty acids, monoglycerol ethers of $C_8$ to $C_{18}$ fatty alcohols, and mixtures thereof.

A method for manufacturing a liquid washing or cleaning agent having a yield point, containing: 5 to 20 wt % anionic surfactant selected from the group consisting of sulfonate surfactants, sulfate surfactants, and mixtures thereof; 1 to 15 wt % nonionic surfactant selected from the group consisting of alkoxylated fatty alcohols having a degree of alkoxylation ≥4, alkoxylated fatty acid alkyl esters, fatty acid amides, alkoxylated fatty acid amides, polyhydroxy fatty acid amides, alkyl phenol polyglycol ethers, amine oxides, alkylpolyglucosides, and mixtures thereof; and in which 0.5 to 10 wt % of an inorganic salt, and 0.5 to 5 wt % of a cosurfactant that is selected from the group consisting of alkoxylated $C_8$ to $C_{18}$ fatty alcohols having a degree of alkoxylation ≤3, aliphatic $C_6$ to $C_{14}$ alcohols, aromatic $C_6$ to $C_{14}$ alcohols, aliphatic $C_6$ to $C_{12}$ dialcohols, monoglycerides of $C_{12}$ to $C_{18}$ fatty acids, monoglycerol ethers of $C_8$ to $C_{18}$ fatty alcohols, and mixtures thereof; are added to the liquid washing or cleaning agent.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The object of the invention is achieved by a liquid washing or cleaning agent having a yield point, containing

- 5 to 20 wt % anionic surfactant selected from the group consisting of sulfonate surfactants, sulfate surfactants, and mixtures thereof,
- 1 to 15 wt % nonionic surfactant selected from the group consisting of alkoxylated fatty alcohols having a degree of alkoxylation ≥4, alkoxylated fatty acid alkyl esters, fatty acid amides, alkoxylated fatty acid amides, polyhydroxy fatty acid amides, alkyl phenol polyglycol ethers, amine oxides, alkylpolyglucosides, and mixtures thereof,
- 0.5 to 10 wt % of an inorganic salt, and
- 0.5 to 5 wt % of a cosurfactant selected from the group consisting of alkoxylated $C_8$ to $C_{18}$ fatty alcohols having a degree of alkoxylation ≤3, aliphatic $C_6$ to $C_{14}$ alcohols, aromatic $C_6$ to $C_{14}$ alcohols, aliphatic $C_6$ to $C_{12}$ dialcohols, monoglycerides of $C_{12}$ to $C_{18}$ fatty acids, monoglycerol ethers of $C_8$ to $C_{18}$ fatty alcohols, and mixtures thereof.

It has been found, surprisingly, that as a result of the addition of selected quantities of an inorganic salt and of a specific cosurfactant to a liquid washing or cleaning agent having a special surfactant system comprising selected anionic and nonionic surfactants, an internally structured washing or cleaning agent having a yield point is obtained. This washing or cleaning agent is capable of dispersing particles in stable fashion without the addition of a polymeric thickening agent. The possibility of omitting polymeric thickening agents has the advantage not only that the agents can be manufactured more simply and cost-effectively, but additionally that undesired side effects of a polymeric thickening agent, such as graying when treating textiles, are avoided. In a preferred embodiment, the washing or cleaning agent is accordingly free of polymeric thickening agent. The washing or cleaning agent is moreover stable even without the addition of another polymeric stabilizer or dispersant. The washing or cleaning agents can also be used without difficulty in automatic washing or cleaning agents, since their inorganic salt content is appreciably reduced as compared with washing or cleaning agents known in the existing art.

It is preferred that the anionic surfactant be selected from the group comprising $C_{9-13}$ alkylbenzenesulfonates, olefinsulfonates, $C_{12-18}$ alkanesulfonates, ester sulfonates, alk(en)yl sulfates, fatty alcohol ether sulfates, and mixtures thereof.

It has been found that these sulfonate and sulfate surfactants are particularly well suited for manufacturing stable liquid washing agents having a yield point. Liquid washing or cleaning agents that comprise $C_{9-13}$ alkylbenzenesulfonates and fatty alcohol ether sulfates as an anionic surfactant exhibit particularly good dispersing properties.

It is preferred that the inorganic salt be selected from the group consisting of sodium chloride, potassium chloride, sodium sulfate, sodium carbonate, potassium sulfate, potassium carbonate, sodium hydrogen carbonate, potassium hydrogen carbonate, calcium chloride, magnesium chloride, and mixtures thereof, since these salts are very easily water-soluble.

It is further preferred that the cosurfactant have a degree of alkoxylation ≤3.

In a particularly preferred embodiment the washing or cleaning agent additionally contains dispersed particles. The dispersed particles can comprise capsules, abrasive substances, and/or insoluble constituents of the washing or cleaning agent. Capsules represent preferred dispersed particles, since with them, sensitive, chemically or physically incompatible, and volatile components (=active agents) of the liquid washing or cleaning agent can be enclosed in a shelf-stable and transport-stable manner.

In a preferred embodiment of the invention the washing or cleaning agent contains at least one enzyme. The use of enzymes in washing agents has been known for many years and has become standard.

But because protease itself, and other enzymes, are proteins, the protease tends to degrade itself, or to degrade other enzymes, in liquid washing agents. It is therefore necessary to stabilize enzymes, in particular in liquid systems. In the existing art this is usually accomplished by inhibiting the protease, the active center being reversibly blocked. Stabilization of this kind is usually achieved with borax, boric acids, boronic acids, or salts or esters thereof, and/or by the use of polyols. It has now been found, surprisingly, that the liquid structured washing or cleaning agents can be used to enhance the stability of enzymes. It has been found in this context that the use of usual enzyme stabilizers can be decreased, in fact that the use of usual enzyme stabilizers can be entirely omitted.

In a preferred embodiment of the invention, liquid structured and enzyme-containing washing or cleaning agents are therefore free of borax, boric acids, boronic acids, or salts or esters thereof. To be mentioned thereamong are principally derivatives having aromatic groups, for example ortho-, meta-, or para-substituted phenylboronic acids, in particular 4-formylphenylboronic acid (4-FPBA), or salts or esters of the aforesaid compounds.

A stabilizing agent for enzymes in liquid washing or cleaning agents that is known from the literature is polyols, in particular glycerol as well as 1,2-propylene glycol. It has been found, surprisingly, that such polyols are not necessary for the stabilization of enzymes in the liquid structured washing or cleaning agents. In a further preferred embodiment of the invention, the liquid washing or cleaning agents according to the present invention are therefore free of glycerol and 1,2-propylene glycol.

In a further preferred embodiment of the invention, liquid structured and enzyme-containing washing or cleaning agents do not comprise either polymeric thickening agents or borax, boric acids, boronic acids, or salts or esters thereof.

In a further preferred embodiment of the invention, liquid structured and enzyme-containing washing or cleaning agents do not comprise either glycerol and/or 1,2-propylene glycol or borax, boric acids, boronic acids, or salts or esters thereof.

In a further preferred embodiment of the invention, liquid structured and enzyme-containing washing or cleaning agents do not comprise either glycerol and/or 1,2-propylene glycol or polymeric thickening agents or borax, boric acids, boronic acids, or salts or esters thereof.

The invention further relates to the use of the washing or cleaning agent according to the present invention for washing and/or cleaning textile fabrics or hard surfaces.

The invention also comprises the use of a combination of 0.5 to 10 wt % of an inorganic salt and 0.5 to 5 wt % of a cosurfactant to generate a yield point in a liquid washing or cleaning agent containing

- 5 to 20 wt % anionic surfactant selected from the group consisting of sulfonate surfactants, sulfate surfactants, and mixtures thereof,
- 1 to 15 wt % nonionic surfactant selected from the group consisting of alkoxylated fatty alcohols having a degree of alkoxylation ≥4, alkoxylated fatty acid alkyl esters, fatty acid amides, alkoxylated fatty acid amides, polyhydroxy fatty acid amides, alkyl phenol polyglycol ethers, amine oxides, alkylpolyglucosides, and mixtures thereof, wherein the cosurfactant is selected from the group consisting of alkoxylated $C_8$ to $C_{18}$ fatty alcohols having a degree of alkoxylation ≤3, aliphatic $C_6$ to $C_{14}$ alcohols, aromatic $C_6$ to $C_{14}$ alcohols, aliphatic $C_6$ to $C_{12}$ dialcohols, monoglycerides of $C_{12}$ to $C_{18}$ fatty acids, monoglycerol ethers of $C_8$ to $C_{18}$ fatty alcohols, and mixtures thereof.

In a further aspect, the invention relates to a method for manufacturing a liquid washing or cleaning agent having a yield point, containing

- 5 to 20 wt % anionic surfactant selected from the group consisting of sulfonate surfactants, sulfate surfactants, and mixtures thereof,
- 1 to 15 wt % nonionic surfactant selected from the group consisting of alkoxylated fatty alcohols having a degree of alkoxylation ≥4, alkoxylated fatty acid alkyl esters, fatty acid amides, alkoxylated fatty acid amides, polyhydroxy fatty acid amides, alkyl phenol polyglycol ethers, amine oxides, alkylpolyglucosides, and mixtures thereof, and in which 0.5 to 10 wt % of an inorganic salt, and 0.5 to 5 wt % of a cosurfactant that is selected from the group consisting of alkoxylated $C_8$ to $C_{18}$ fatty alcohols having a degree of alkoxylation ≤3, aliphatic $C_6$ to $C_{14}$ alcohols, aromatic $C_6$ to $C_{14}$ alcohols, aliphatic $C_6$ to $C_{12}$ dialcohols, monoglycerides of $C_{12}$ to $C_{18}$ fatty acids, monoglycerol ethers of $C_8$ to $C_{18}$ fatty alcohols, and mixtures thereof, are added to the liquid washing or cleaning agent.

The invention will be described below in further detail, inter alia with reference to examples. Unless otherwise indicated, throughout the application all quantities are indicated in wt % active substance, based on the total washing or cleaning agent.

The liquid washing or cleaning agent contains an anionic surfactant, a nonionic surfactant, an inorganic salt, and a cosurfactant.

Sulfonates and/or sulfates are used as an anionic surfactant. The anionic surfactant content is 5 to 20 wt % and preferably 8 to 15 wt %, based in each case on the total washing or cleaning agent.

Possibilities as surfactants of the sulfonate type are preferably $C_{9-13}$ alkylbenzenesulfonates, olefinsulfonates, i.e. mixtures of alkene- and hydroxyalkanesulfonates, and disulfonates, for example such as those obtained from $C_{12-18}$ monoolefins having a terminal or internal double bond, by sulfonation with gaseous sulfur trioxide and subsequent alkaline or acid hydrolysis of the sulfonation products. Also suitable are $C_{12-18}$ alkanesulfonates and the esters of α-sulfo fatty acids (estersulfonates), for example α-sulfonated methyl esters of hydrogenated coconut, palm-kernel, or tallow fatty acids.

Preferred alk(en)yl sulfates are alkali and in particular sodium salts of sulfuric acid semi-esters of $C_{12-18}$ fatty alcohols, for example from coconut fatty alcohol, tallow fatty alcohol, lauryl, myristyl, cetyl, or stearyl alcohol, or $C_{10}$ to $C_{20}$ oxo alcohols, and those semi-esters of secondary alcohols of those chain lengths. For purposes of washing technology, the $C_{12}$ to $C_{16}$ alkyl sulfates and $C_{12}$ to $C_{15}$ alkyl sulfates, as well as $C_{14}$ to $C_{15}$ alkyl sulfates, are preferred. 2,3-Alkyl sulfates are also suitable anionic surfactants.

Fatty alcohol ether sulfates, such as sulfuric acid monoesters of straight-chain or branched $C_{7-21}$ alcohols ethoxylated with 1 to 6 mol ethylene oxide, for example 2-methyl-branched $C_{9-11}$ alcohols with an average of 3.5 mol ethylene oxide (EU) or $C_{12-18}$ fatty alcohols with 1 to 4 EU, are also suitable.

It is preferred that the liquid washing or cleaning agent contain a mixture of sulfonate surfactants and sulfate surfactants. In a particularly preferred embodiment the liquid washing or cleaning agent contains $C_{9-13}$ alkylbenzenesulfonates and fatty alcohol ether sulfates as anionic surfactant. The ratio of sulfate surfactants to sulfonate surfactants is preferably in the range from 3:1 to 1:3, and more preferably in the range from 3:1 to 1:1. In a particularly preferred embodiment the liquid washing or cleaning agent contains fatty alcohol ether sulfates and $C_{9-13}$ alkylbenzenesulfonates at a 2:1 ratio.

In addition to the anionic surfactant, the liquid washing or cleaning agent can also contain soaps. Saturated and unsaturated fatty acid soaps are suitable, such as the salts of lauric acid, myristic acid, palmitic acid, stearic acid, (hydrogenated) erucic acid, and behenic acid, as well as soap mixtures derived in particular from natural fatty acids, for example coconut, palm-kernel, olive-oil, or tallow fatty acids.

Anionic surfactants as well as soaps can be present in the form of their sodium, potassium, or magnesium or ammonium salts. The anionic surfactants are present preferably in the form of their sodium salts. Further preferred counter ions for anionic surfactants are also the protonated forms of choline, triethylamine, monoethanolamine, or methylethylamine.

The quantity of soap in the liquid washing or cleaning agent is preferably up to 5 wt % and more preferably up to 2 wt %, based on the total quantity of washing or cleaning agent.

Besides the anionic surfactant, the washing or cleaning agent also contains nonionic surfactant. The nonionic surfactant comprises alkoxylated fatty alcohols, alkoxylated fatty acid alkyl esters, fatty acid amides, alkoxylated fatty acid amides, polyhydroxy fatty acid amides, alkylphenol polyglycol ethers, amine oxides, alkypolyglucosides, and mixtures thereof.

The nonionic surfactant used is preferably alkoxylated, advantageously ethoxylated, in particular primary alcohols having preferably 8 to 18 carbon atoms and an average of 4 to 12 mol ethylene oxide (EO) per mol of alcohol, in which the alcohol residue can be linear or preferably methyl-branched in the 2-position or can contain mixed linear and methyl-branched residues, such as those that are usually present in oxo alcohol residues. Particularly preferred, however, are alcohol ethoxylates having linear residues made up of alcohols of natural origin having 12 to 18 carbon atoms, e.g. from coconut, palm, tallow, or oleyl alcohol, and an average of 5 to 8 EO per mol of alcohol. The preferred ethoxylated alcohols include, for example, $C_{12-14}$ alcohols with 4 EO or 7 EO, $C_{9-11}$ alcohol with 7 EO, $C_{13-15}$ alcohols with 5 EO, 7 EO, or 8 EO, $C_{12-18}$ alcohols with 5 EO or 7 EO, and mixtures thereof. The degrees of ethoxylation indicated represent statistical averages that can correspond to an integer or a fractional number for a specific product. Preferred alcohol ethoxylates exhibit a restricted distribution of homologs (narrow range ethoxylates, NRE). In addition to these nonionic surfactants, fatty alcohols with more than 12 EO can also be used. Examples thereof are tallow fatty alcohol with 14 EO, 25 EU, 30 EU, or 40 EU. Nonionic surfactants that contain EO and PO groups together in the molecule are also usable according to the present invention. A mixture of a (more highly) branched ethoxylated fatty alcohol and an unbranched ethoxylated fatty alcohol is also suitable, for example a mixture of a $C_{16-18}$ fatty alcohol with 7 EO and 2-propylheptanol with 7 EO. Particularly preferably, the washing, cleaning, or post-treatment agent or washing adjuvant contains as a nonionic surfactant a $C_{12-18}$ fatty alcohol with 7 EU or a $C_{13-15}$ oxoalcohol with 7 EO.

The nonionic surfactant content is 1 to 15 wt % and preferably 2 to 10 wt %, based in each case on the total washing or cleaning agent.

The total quantity of anionic and nonionic surfactant in the liquid washing or cleaning agent is up to 35 wt %, preferably up to 15 wt %, based on the total liquid washing or cleaning agent.

A further essential constituent of the washing or cleaning agent is the inorganic salt. The latter is employed in a quantity from 0.5 to 10 wt %, preferably in a quantity from 1 to 8 wt %, and very particularly preferably 2 to 5 wt %, based in each case on the total washing or cleaning agent, depending on the surfactant system used.

Preferred inorganic salts comprise sodium chloride, potassium chloride, sodium sulfate, sodium carbonate, potassium sulfate, potassium carbonate, sodium hydrogen carbonate, potassium hydrogen carbonate, calcium chloride, magnesium chloride, and mixtures thereof. Particularly stable washing or cleaning agents are obtained with the use of sodium chloride or mixtures of sodium chloride and potassium sulfate.

Addition of the inorganic salt assists the formation of lamellar structures. The inorganic salt additionally has an influence on the viscosity of the washing or cleaning agent, and with the aid of the inorganic salt the viscosity can be adjusted in such a way that the washing or cleaning agent can readily be dispensed and a container having the washing or cleaning-agent preparation exhibits good emptying characteristics.

The washing or cleaning agent according to the present invention obligatorily contains a cosurfactant that is selected from the group consisting of alkoxylated $C_8$ to $C_{18}$ fatty alcohols having a degree of alkoxylation ≤3, aliphatic $C_6$ to $C_{14}$ alcohols, aromatic $C_6$ to $C_{14}$ alcohols, aliphatic $C_6$ to $C_{12}$ dialcohols, monoglycerides of $C_{12}$ to $C_{18}$ fatty acids, monoglycerol ethers of $C_8$ to $C_{18}$ fatty alcohols, and mixtures thereof. This cosurfactant is employed in a quantity from 0.5 to 5 wt %, preferably in a quantity from 1 to 4.5 wt %, and very particularly preferably 2 to 4 wt %, based in each case on the total washing or cleaning agent.

"Cosurfactants" according to this application are amphiphilic molecules having a small hydrophilic head group. These cosurfactants are only weakly soluble, or in fact insoluble, in a binary system with water, and correspondingly also do not form micelles therein. In the presence of the claimed anionic and nonionic surfactants, the cosurfactants are incorporated into their associates and thereby change the morphology of those associates. The spherical micelles become rod- and/or disk-shaped micelles. With a sufficiently high total surfactant content, what results is the desired formation of lamellar phases or structures.

The inorganic salt and the cosurfactant thus contribute to formation of the lamellar phases or structures. Addition of the inorganic salt and the cosurfactant to the selected surfactant system produces an internally structured liquid washing or cleaning agent having very good dispersing properties. The resulting liquid washing or cleaning agent is extremely stable and exhibits no phase separation and/or precipitation whatsoever of the anionic and/or nonionic surfactants.

Suitable alkoxylated $C_{12}$ to $C_{18}$ fatty alcohols having a degree of alkoxylation ≤3 encompass, for example, i-$C_{13}H_{27}O(CH_2CH_2O)_2H$, i-$C_{13}H_{27}O(CH_2CH_2O)_3H$, $C_{12-14}$ alcohol with 2 BO, $C_{12-14}$ alcohol with 3 EO, $C_{13-15}$ alcohol with 3 EO, $C_{12-18}$ alcohols with 2 EO, and $C_{12-18}$ alcohols with 3 EO.

Further suitable cosurfactants are 1-hexanol, 1-heptanol, 1-octanol, 1,2-octanediol, glycerol monostearate, and mixtures thereof.

Scent alcohols such as geraniol, or scent aldehydes such lilial or decanal, are likewise suitable as cosurfactants.

Preferred cosurfactants are $C_{12}$ to $C_{18}$ fatty alcohols having a degree of alkoxylation ≤3. These cosurfactants become particularly effectively incorporated into the associates of the anionic and nonionic surfactant.

It can be preferred for the washing or cleaning agent additionally to contain a $C_{12}$ to $C_{18}$ fatty acid. $C_{12}$ to $C_{18}$ fatty acids can have a positive influence on the formation of lamellar structures or phases, and in particular can assist the formation thereof.

It can be particularly preferred for the washing or cleaning agent to contain the neutralized and the non-neutralized form of a $C_{12}$ to $C_{18}$ fatty acid. This is advantageous in particular with washing or cleaning agents containing fatty acid soaps, since with these it is very simple to adjust the concentration of non-neutralized fatty acid by way of the pH, for example by adding pH adjusting agents. Suitable $C_{12}$ to $C_{18}$ fatty acids comprise lauric acid, myristic acid, palmitic acid, stearic acid, (hydrogenated) erucic acid, behenic acid, coconut fatty acid, palm-kernel fatty acid, olive-oil fatty acid, and/or tallow fatty acid.

The concentration of non-neutralized fatty acid in a liquid washing or cleaning agent containing fatty acid soap can be determined on the one hand experimentally (e.g. by titration) or (if the pKa value of the fatty acid used is known) using the Henderson-Hasselbalch equation.

Alternatively, the fatty acid soap can be derived from a fatty acid different from the $C_{12}$ to $C_{18}$ fatty acid employed to further assist the formation of lamellar structures or phases.

In addition to the anionic surfactant, nonionic surfactant, inorganic salt, and cosurfactant, the washing or cleaning agent can contain further ingredients that further improve the applications-engineering and/or aesthetic properties of the washing or cleaning agent. In the context of the present invention, the washing or cleaning agent preferably additionally contains one or more substances from the group of builders, bleaching agents, enzymes, electrolytes, nonaqueous solvents, pH adjusting agents, perfumes, perfume carriers, fluorescence agents, dyes, hydrotopes, foam inhibitors, silicone oils, anti-redeposition agents, anti-gray agents, shrinkage preventers, wrinkle-prevention agents, color transfer inhibitors, antimicrobial active agents, germicides, fungicides, antioxidants, preservatives, corrosion inhibitors, antistatic agents, bittering agents, ironing adjuvants, proofing and impregnation agents, swelling and anti-slip agents, softening components, and UV absorbers.

In a preferred embodiment the washing or cleaning agent is free of polymeric thickening agent.

Silicates, aluminum silicates (in particular zeolites), carbonates, salts of organic di- and polycarboxylic acids, and mixtures of said substances are to be mentioned in particular as builders that can be contained in the washing or cleaning agent.

Organic builders that can be present in the washing or cleaning agent are, for example, the polycarboxylic acids usable in the form of their sodium salts, "polycarboxylic acids" being understood as those carboxylic acids which carry more than one acid function. These are, for example, citric acid, adipic acid, succinic acid, glutaric acid, malic acid, tartaric acid, maleic acid, fumaric acid, sugar acids, aminocarboxylic acids, nitrilotriacetic acid (NTA), methylglycinediacetic acid (MGDA) and their descendants, as well as mixtures thereof. Preferred salts are the salts of polycarboxylic acids such as citric acid, adipic acid, succinic acid, glutaric acid, tartaric acid, sugar acids, and mixtures thereof.

Polymeric polycarboxylates are also suitable as builders. These are, for example, the alkali metal salts of polyacrylic acid or of polymethacrylic acid, for example those having a relative molecular weight from 600 to 750,000 g/mol.

Suitable polymers are, in particular, polyacrylates, which preferably have a molecular weight from 1000 to 15,000 g/mol. From that group, the short-chain polyacrylates that have molar masses from 1000 to 10,000 g/mol, and particularly preferably from 1000 to 5000 g/mol, can in turn be preferred because of their superior solubility.

Also suitable are copolymeric polycarboxylates, in particular those of acrylic acid with methacrylic acid and of acrylic acid or methacrylic acid with maleic acid. To improve water solubility, the polymers can also contain allylsulfonic acids, such as allyloxybenzenesulfonic acid and methallylsulfonic acid, as monomers.

It is preferred, however, to use soluble builders, for example citric acid or acrylic polymers having a molar mass from 1000 to 5000 g/mol, in the liquid washing or cleaning agents.

In a particularly preferred embodiment the liquid washing or cleaning agent contains an enzyme or a mixture of enzymes. The most significant washing-agent enzyme is protease. Also suitable besides proteases, however, are in particular those from the class of hydrolases, such as (poly) esterases, lipases, amylases, glycosyl hydrolases, hemicellulase, cutinases, β-glucanases, oxidases, peroxidases, mannanases, perhydrolases, oxireductases, and/or laccases.

The quantity of enzyme or enzymes is 0.01 to 10 wt %, preferably 0.12 to approximately 3 wt %, based on the total washing or cleaning agent. The enzymes are employed preferably as (a) liquid enzyme formulation(s).

With no intention of being limited to this theory, it is assumed that the macroscopic single-phase nature resulting from the lamellar phase exhibits microcompartmentalization. It is presumed that the enzyme molecules are caught between the layers, and the mobility of the enzymes is correspondingly restricted. As a result, they cannot diffusively encounter one another and inactivate each other, even if they are not inhibited. In a very particularly preferred embodiment of the invention, the repetition length of the lamellar phase (periodicity) is between 10 and 20 nm, preferably 11 to 16 nm, and with even greater preference 12 to 14 nm. Repetition lengths of this kind can be calculated, for example, from small-angle X-ray scattering (SAXS) measurements.

The washing or cleaning agents are liquid, and contain water as a principal solvent. It is preferred in this context that the washing or cleaning agent contain more than 5 wt %, preferably more than 15 wt %, and particularly preferably more than 25 wt % water, based in each case on the total quantity of washing or cleaning agent.

Nonaqueous solvents can additionally be added to the washing or cleaning agent. Suitable nonaqueous solvents comprise mono- or polyvalent alcohols, alkanolamines, or glycol ethers, provided they are miscible with water in the concentration range indicated. The solvents are preferably selected from ethanol, n-propanol, isopropanol, butanols, glycol, propanediol, butanediol, methylpropanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol monomethyl ether, dipropylene glycol monoethyl ether, methoxytriglycol, ethoxytriglycol, butoxytriglycol, 1-butoxyethoxy-2-propanol, 3-methyl-3-methoxybutanol, propylene glycol t-butyl ether, di-n-octyl ether, and mixtures of said solvents. It is preferred, however, that the washing or cleaning agent contain an alcohol, in particular ethanol and/or glycerol, in quantities between 0.5 and 5 wt % based on the total washing or cleaning agent.

In addition to these constituents, a washing or cleaning agent can contain dispersed particles whose diameter along their largest physical dimension is preferably 1 to 1000 μm.

"Particles" for purposes of this invention can be capsules, abrasive substances, as well as powders, granulates, or combinations of compounds insoluble in the washing or cleaning agent, capsules being preferred.

The term "capsule" is understood on the one hand as aggregates having a core-shell structure and on the other hand as aggregates having a matrix. Core-shell capsules contain at least one solid or liquid core which is surrounded by a continuous shell, in particular a shell made of polymer(s).

Sensitive, chemically or physically incompatible, and volatile components (=active agents) of the liquid washing or cleaning agent can be enclosed in shelf-stable and transport-stable fashion in the interior of the capsules. For example, optical brighteners, surfactants, complexing agents, bleaching agents, bleach activators, dyes and scents, antioxidants, builders, enzymes, enzyme stabilizers, antimicrobial active agents, anti-gray agents, anti-redeposition agents, pH adjusting agents, electrolytes, washing power intensifiers, vitamins, proteins, foam inhibitors, and UV absorbers can be present in the capsules. The fillings of the capsules can be solids or liquids in the form of solutions or of emulsions or suspensions.

The capsules can have any shape within the context of manufacturing requirements, but preferably they are approximately spherical. Depending on the components contained in their interior, and on their utilization, their diameter along their largest physical dimension can be between 1 μm and 1000 μm.

Alternatively, it is also possible to employ particles that do not have a core-shell structure but in which the active agent is instead distributed in a matrix made of a matrix-forming material. Such particles are also referred to as "matrix particles."

Matrix formation with such materials is accomplished, for example, by gelling, polyanion-polycation interactions, or polyelectrolyte-metal ion interactions, and is well known in the existing art, as is the manufacture of particles having these matrix-forming materials. Alginate is an example of a matrix-forming material. For the manufacture of alginate-based "speckles," an aqueous alginate solution that also contains the active agent or agents to be enclosed is drip-fed and then cured in a precipitation bath containing $Ca^{2+}$ ions or $Al^{3+}$ ions. Other matrix-forming materials can alternatively be used instead of alginate.

The particles can be dispersed in stable fashion in the liquid washing or cleaning agents. "Stable" means that the washing or cleaning agents are stable at room temperature over a period of at least 4 weeks, and preferably at least 6 weeks, with no "creaming" or sedimentation of the particles in the agent.

Release of the active substances from the capsules is usually accomplished by destruction of the envelope or matrix as a result of mechanical, thermal, chemical, or enzymatic action.

In a preferred embodiment the liquid washing or cleaning agents contain capsules in which one or more scents are contained.

Alternatively, the particles can comprise abrasive substances such as microspheres of plastic or calcium carbonate, as well as powders, granulates, or combinations of compounds insoluble in the washing or cleaning agent.

In a preferred embodiment of the invention the liquid washing or cleaning agents contain identical or different particles in quantities from 0.05 to 10 wt %, in particular 0.1 to 8 wt %, and extremely preferably 0.2 to 5 wt %.

The washing or cleaning agent according to the present invention can be used to wash and/or clean textile fibers or hard surfaces.

The washing or cleaning agent is manufactured by means of usual and known methods and processes. For example, the constituents of the washing or cleaning agents can be mixed in agitator vessels, water firstly being made ready. The non-aqueous solvents and surfactants, including the cosurfactant, are then added. The fatty acid, if present, is then added, and saponification of the fatty acid portion then occurs, as well as neutralization of the anionic surfactants which are utilized in acid form. The further constituents are then added, preferably in portions. The inorganic salt can be added at various points in time in the manufacturing process, as a solid or in the form of a concentrated solution.

The yield points of the washing or cleaning agents were determined using a model AR G2 rotational rheometer of the TA Instruments company. This is a so-called "controlled shear stress" rheometer.

The literature describes a variety of methods, known to one skilled in the art, for measuring a yield point using a controlled shear stress rheometer.

In order to determine the yield points in the context of the present invention, the following procedure was used at 23° C.:

A shear stress s(t) increasing over time was applied to the samples in the rheometer. For example, the shear stress can be raised over the course of 10 minutes from the lowest possible value (e.g. 2 mPa) to, for example, 10 Pa. The deformation $\gamma$ of the sample as a function of that shear stress is measured. The deformation is plotted against shear stress using a log-log plot. If the sample being investigated has a yield point, two regions in this plot can be clearly distinguished. Below a certain shear stress, entirely elastic deformation is seen. The slope of the $\gamma(\sigma)$ curve (log-log plot) in this region is one. Above this shear stress the flow region begins, and the slope of the curve becomes abruptly greater. The shear stress at which the inflection of the curve occurs, i.e. the transition from elastic to plastic deformation, marks the yield point. The inflection point can conveniently be determined by laying tangents against the two parts of the curve. Samples with no yield point do not exhibit a characteristic inflection in the $\gamma(\sigma)$ function.

The compositions of three washing or cleaning agents E1 to E3 according to the present invention, as well as the compositions of a comparison example V1, are shown in Table 1 below (all quantities indicated in wt % active substance, based on the total washing or cleaning agent).

TABLE 1

| | wt % | | | |
|---|---|---|---|---|
| Ingredients | V1 | E1 | E2 | E3 |
| $C_{12}$-$C_{18}$ ROH with 7 OH | 2 | 2 | 2 | 4 |
| Sodium lauryl ether sulfate (2 EO) | 8 | 8 | 8 | 8 |
| $C_{12}$-$C_{18}$ fatty acid | 1 | 1 | 1 | 1 |
| Linear $C_{9-13}$ alkylbenzenesulfonic acid, sodium salt | 4 | 4 | 4 | 4 |
| Phosphonic acid, sodium salt | 0.8 | 0.8 | 0.8 | 0.8 |
| Optical brightener | 0.1 | 0.1 | 0.1 | 0.1 |
| Silicone defoamer | 0.02 | 0.02 | 0.02 | 0.02 |
| Citric acid | 2.5 | 2.5 | 2.5 | 2.5 |
| Boric acid | 1.1 | 1.1 | 1.1 | 1.1 |
| Ethanol | 3 | 3 | 3 | 3 |
| Enzymes (cellulase, amylase & protease) | 1.8 | 1.8 | 1.8 | 1.8 |
| Perfume | 0.2 | 0.2 | — | 0.2 |
| Perfume capsules (Ø = 15 μm) | — | — | 0.2 | — |
| Dye | 0.0001 | 0.0001 | 0.0001 | 0.0001 |
| NaCl | 3 | 3 | 3 | 5 |
| i-$C_{13}$ ROH with 3 EO | — | 4 | 4 | — |
| Hexanol | — | — | — | 2 |
| Water | to 100 | to 100 | to 100 | to 100 |
| NaOH (50%) | to pH 7 | to pH 7 | to pH 7 | to pH 7 |
| Yield point | — | + | + | + |

The three washing or cleaning agents E1 to E3 were stable for 6 weeks at room temperature. Washing or cleaning agent E2 in particular exhibited no appreciable creaming and/or sedimentation of the dispersed capsules.

The comparison example V1 shows clearly that the addition of inorganic salt alone does not result in a liquid washing or cleaning agent having a yield point. In the comparison example the inorganic salt was present in the claimed quantity range, but because the cosurfactant was absent the resulting washing or cleaning agents do not exhibit a yield point. In addition, the washing or cleaning agent V1 separates into two phases.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A liquid washing or cleaning agent having a yield point, comprising:

5 to 20 wt % anionic surfactant selected from the group consisting of sulfonate surfactants, sulfate surfactants, and mixtures thereof;

1 to 15 wt % nonionic surfactant selected from the group consisting of alkoxylated fatty alcohols having a degree of alkoxylation ≥4, alkoxylated fatty acid alkyl esters, fatty acid amides, alkoxylated fatty acid amides, polyhydroxy fatty acid amides, alkyl phenol polyglycol ethers, amine oxides, alkylpolyglucosides, and mixtures thereof;

0.5 to 10 wt % of an inorganic salt; and 0.5 to 5 wt % of a cosurfactant selected from the group consisting of 1-hexanol, 1-heptanol, 1-octanol, 1,2-octandiol, glycerol monostearate, and mixtures thereof.

2. The liquid washing or cleaning agent according to claim 1, wherein the anionic surfactant is selected from the group consisting of $C_{9-13}$ alkylbenzenesulfonates, olefinsulfonates, $C_{12-18}$ alkanesulfonates, ester sulfonates, alk(en)yl sulfates, fatty alcohol ether sulfates, and mixtures thereof.

3. The liquid washing or cleaning agent according to claim 2, wherein the anionic surfactant comprises $C_{9-13}$ alkylbenzenesulfonates and fatty alcohol ether sulfates.

4. The liquid washing or cleaning agent according to claim 1, wherein the inorganic salt is selected from the group consisting of sodium chloride, potassium chloride, sodium sulfate, sodium carbonate, potassium sulfate, potassium carbonate, sodium hydrogen carbonate, potassium hydrogen carbonate, calcium chloride, magnesium chloride, and mixtures thereof.

5. The liquid washing or cleaning agent according to claim 1, wherein the cosurfactant is a $C_{12}$ to $C_{18}$ fatty alcohol having a degree of alkoxylation ≤3.

6. The liquid washing or cleaning agent according to claim 1, wherein the liquid washing or cleaning agent contains dispersed particles.

7. The liquid washing or cleaning agent according to claim 6, wherein the dispersed particles are capsules, abrasive substances, and/or insoluble constituents of the washing or cleaning agents.

8. The liquid washing or cleaning agent according to claim 1, wherein the washing or cleaning agent is free of thickening agents.

9. The liquid washing or cleaning agent according to claim 1, wherein the washing or cleaning agent additionally contains a $C_{12}$ to $C_{18}$ fatty acid.

10. The liquid washing or cleaning agent according to claim 1, wherein it further comprises at least one enzyme.

11. The liquid washing or cleaning agent according to claim 1, wherein it is free of borax, boric acids, boronic acids, or salts or esters thereof.

12. The liquid washing or cleaning agent according to claim 1, wherein it contains no glycerol and/or 1,2-propylene glycol.

* * * * *